US010982612B1

(12) United States Patent
Carlson et al.

(10) Patent No.: US 10,982,612 B1
(45) Date of Patent: Apr. 20, 2021

(54) PUMP LIFE PREDICTION SYSTEM

(71) Applicant: Caterpillar Inc., Peoria, IL (US)

(72) Inventors: Joshua D. Carlson, Peoria, IL (US); Zachary T. Kroehler, Peoria, IL (US); Ryan Hinrichsen, Groveland, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/713,817

(22) Filed: Dec. 13, 2019

(51) Int. Cl.

| | |
|---|---|
| ***F02D 41/22*** | (2006.01) |
| ***F02M 65/00*** | (2006.01) |
| ***F02M 63/02*** | (2006.01) |
| ***F02M 51/04*** | (2006.01) |

(52) U.S. Cl.
CPC ..... *F02D 41/22* (2013.01); *F02M 51/04* (2013.01); *F02M 63/0265* (2013.01); *F02M 65/00* (2013.01); *F02D 2041/224* (2013.01); *F02M 2700/1317* (2013.01)

(58) Field of Classification Search
CPC .... F02D 41/22; F02M 51/04; F02M 63/0265; F02M 65/00
USPC ..... 340/679
See application file for complete search history.

(56) References Cited

U.S. PATENT DOCUMENTS

| | | | | |
|---|---|---|---|---|
| 2004/0030524 | A1* | 2/2004 | Jarrell | G05B 23/0221 702/113 |
| 2004/0167738 | A1* | 8/2004 | Miller | F04B 51/00 702/114 |
| 2008/0215255 | A1* | 9/2008 | Stockner | G06F 30/23 702/34 |
| 2008/0217421 | A1* | 9/2008 | Lewis | F02M 59/366 239/5 |
| 2017/0057667 | A1* | 3/2017 | Ward | F04B 49/065 |
| 2017/0091358 | A1* | 3/2017 | Zhang | G06F 30/17 |
| 2018/0216566 | A1* | 8/2018 | Taxon | F23K 5/04 |

* cited by examiner

*Primary Examiner* — Kerri L McNally
(74) *Attorney, Agent, or Firm* — Bookoff McAndrews

(57) ABSTRACT

A pump life prediction system and methods for predicting pump life of a pump are disclosed. A method may include monitoring pump operating conditions. A value indicative of cavitation damage is determined based on the pump operating conditions. A pump life remaining is determined based on the value. The method may also include outputting an indication of the pump life remaining.

20 Claims, 5 Drawing Sheets

PUMP LIFE PREDICTION SYSTEM

TECHNICAL FIELD

The present disclosure relates generally to high pressure pumps, and more particularly, to a pump life prediction system for such pumps.

BACKGROUND

Fuel pumps for internal combustion engines, such as high pressure common rail pumps, may fail due to cavitation damage in the pump. The severity and accumulation rates of cavitation damage may vary based on pump operating conditions. Pumps may fail due to cavitation damage with little advance warning, which may lead to significant and unplanned engine downtime.

U.S. Patent Application Publication No. 2018/0216566, published on Aug. 2, 2018 ("the '566 publication"), describes methods and systems for health assessments of a fuel system including a high pressure fuel pump. The system measures pressure pulses from the pump caused by pistons of the pump pushing fuel out of the pump towards a fuel rail. The system indicates pump degradation if one or more expected pulses are missing and/or if one or more of the pulses are weaker than expected. However, the system of the '566 publication may not adequately predict pump life remaining.

The pump life prediction system of the present disclosure may solve one or more of the problems set forth above and/or other problems in the art. The scope of the current disclosure, however, is defined by the attached claims, and not by the ability to solve any specific problem.

SUMMARY

In one aspect, a method for predicting pump life of a pump is disclosed. The method may include: monitoring pump operating conditions; determining a value indicative of cavitation damage based on the pump operating conditions; determining a pump life remaining based on the value; and outputting an indication of the pump life remaining.

In another aspect, a method for predicting pump life of a fuel pump for an engine system having a fuel rail is disclosed. The method may include: monitoring pump flow, pump speed, and rail pressure; determining a value indicative of cavitation damage based on at least one of the pump flow, pump speed, and rail pressure; determining a pump life remaining based value; and outputting an indication of the pump life remaining.

In yet another aspect, a pump life prediction system is disclosed. The system may include: a pump; one or more sensors for measuring pump operating conditions; and a controller configured to: monitor the pump operating conditions; determine a value indicative of cavitation damage based on the pump operating conditions; determine a pump life remaining based on the value; and output an indication of the pump life remaining.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
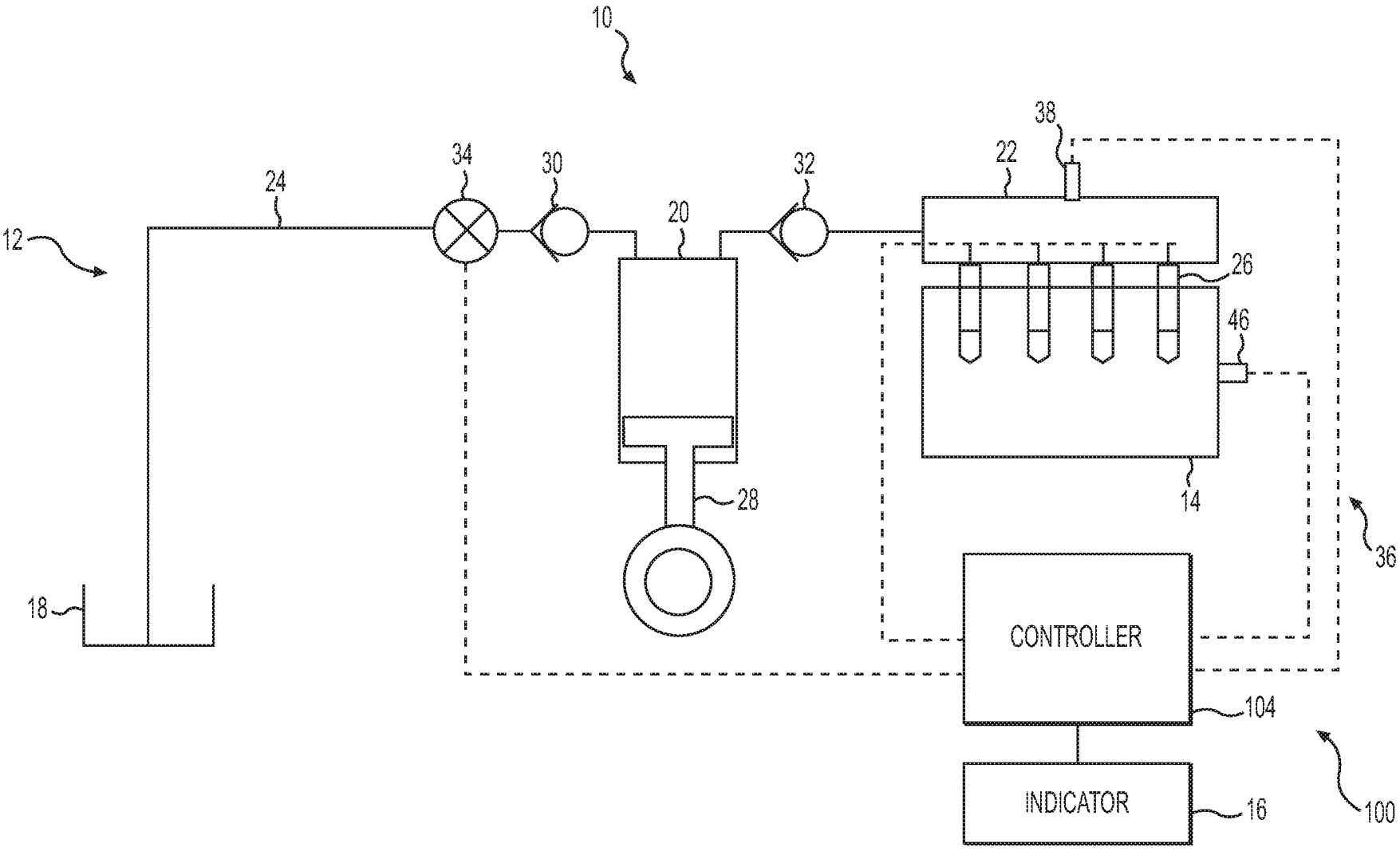
FIG. 1 is a schematic view of an engine system having a pump life prediction system, according to aspects of the disclosure.

FIG. 1 illustrates a schematic view of an engine system 10 system having a pump life prediction system 100. As shown in FIG. 1, engine system 10 includes a fuel system 12, an engine 14, a pump life prediction control system 100, and an output indicator 16. Engine 14 may be an internal combustion engine and may include one or more cylinders (not shown) and a crankshaft (not shown) for providing power to a flywheel (not shown) or the like.

Fuel system 12 includes a fuel tank 18, a pump 20, and a high pressure common rail 22 in communication with each other via a fuel line 24. Common rail 22 may include one or more fuel injectors 26 for injecting fuel into the cylinders of the engine 14. Pump 20 may be a high pressure pump for providing fuel from tank 18 to common rail 22 at a high pressure. A high pressure pump may include a mechanical pump for compressing and pressurizing fluid (e.g., fuel) to high pressures. As such, pump 20 may include one or more plungers 28, one or more inlet valves 30, and one or more outlet valves 32. Plunger 28 may be controllable to move up and down to draw fuel into pump 20 through valve 30 and push pressurized fuel out of pump 20 through valve 32. Pump 20 may further include a valve 34, such as an inlet metering valve, for ensuring that only a quantity of fuel required by the injectors 26 is provided to rail 22. Valve 34 may be any type of valve, such as a solenoid valve, proportional spool valve, or the like. Accordingly, valve 34 may be controllable to various positions between an open position and a closed position for adjusting a fuel flow rate and metering the quantity of fuel to pump 20, and thus to rail 22 for distribution of the fuel to injectors 26. Fuel system 12 may also include a low pressure pump (not shown), such as a fuel transfer pump, between the fuel tank 18 and pump 20 for generating a flow of fuel from fuel tank 18 to pump 20.

Output indicator 16 may indicate pump life remaining of the pump 20. Output indicator 16 may include a display, a gauge, a light, a speaker, or the like. For example, output indicator 16 may indicate a value (numerical value, percentage, or the like) of pump life remaining of pump 20 and/or may indicate (e.g., via a notification) when pump life remaining of pump 20 decreases below a predetermined threshold (e.g., below 10% pump life remaining). Indicator 16 may be located in an operator cab (not shown) and/or may be located remote from engine system 10. While only a single output indicator 16 is described herein, it is understood that output indicator 16 may include one or more indicators and may include any type of indicator for indicating pump life remaining of pump 20.

Pump life prediction system 100 includes a controller 104, such as an engine control module (ECM), and a sensor system 36 connected to controller 104. Sensor system 36 my include one or more sensors for measuring pump operating conditions, such as pressure sensors, speed sensors, or the like. For example, sensor system 36 may include a rail pressure sensor 38 and an engine speed sensor 40. Rail pressure sensor 38 may be located in rail 22 and may sense a rail pressure. Engine speed sensor 40 may be located at the crankshaft of engine 14 and may sense engine speed. Engine speed sensor 40 may be located at any location of engine 14, such as, for example, a crank pulley, the flywheel, a camshaft, or on the crankshaft. It is understood that sensors 38, 40 may include any type of sensors such as resistive sensors, inductive sensors, capacitive sensors, piezoelectric sensors, optical sensors, micro electro-mechanical system sensors, or the like. Further, sensor system 36 may include any number and/or combination of sensors as necessary. Controller 104 may also be in communication with valve 34 for controlling a position of valve 34 and with injectors 26 for regulating and controlling fuel injection into the cylinders of engine 14.

Figure 2:
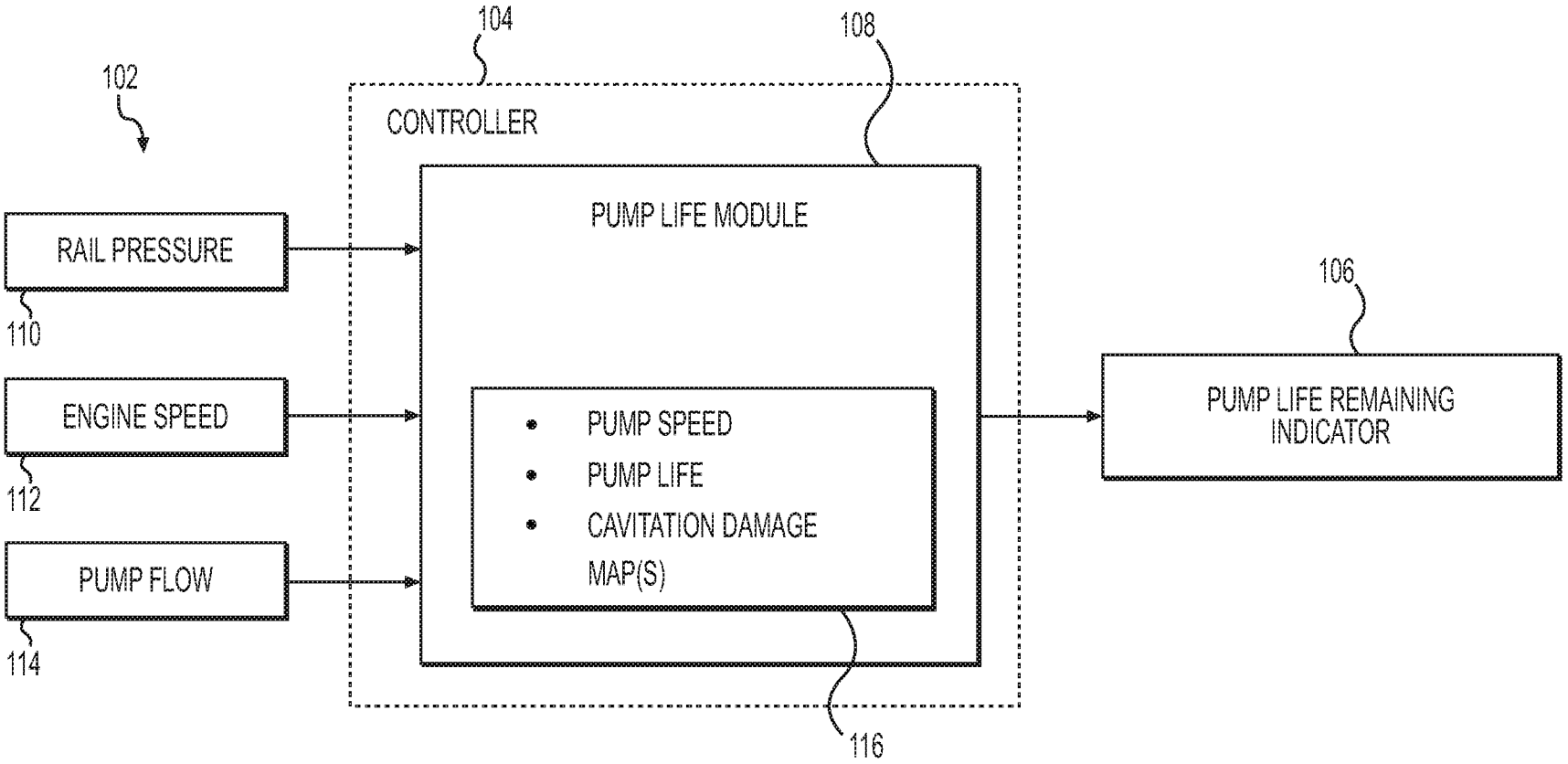
FIG. 2 is a schematic view of the exemplary pump life prediction system for the engine system of FIG. 1.

FIG. 2 illustrates a schematic view of the exemplary pump life prediction system 100 for operation and/or control of at least portions of engine system 10. System 100 may include inputs 102, controller 104, and output 106. Inputs 102 may include, for example, a rail pressure signal 110 from pressure sensor 38, an engine speed signal 112 from engine speed sensor 40, and a pump flow signal 114. Controller 104 may derive the pump flow signal 114 based on a position of valve 34. For example, a value indicative of pump flow may be proportional to the position of valve 34. Output 106 may include, for example, a pump life remaining indicator signal to output indicator 16. Controller 104 also includes a pump life module 108. Pump life module 108 may receive inputs 102, implement a method for predicting pump life and control output 106, as described with reference to FIGS. 4 and 5 below.

Controller 104 may embody a single microprocessor or multiple microprocessors that may include means for predicting pump life of pump 20 for engine system 10. For example, controller 104 may include a memory, a secondary storage device, a processor, such as a central processing unit or any other means for accomplishing a task consistent with the present disclosure. The memory or secondary storage device associated with controller 104 may store data and/or software routines that may assist controller 104 in performing its functions, such as the functions of methods 400 and 500 of FIGS. 4 and 5, respectively. Further, the memory or secondary storage device associated with controller 104 may also store data received from the various inputs 102 associated with pump life prediction system 100. Numerous commercially available microprocessors can be configured to perform the functions of controller 104. It should be appreciated that controller 104 could readily embody a general machine controller capable of controlling numerous other machine functions. Various other known circuits may be associated with controller 104, including signal-conditioning circuitry, communication circuitry, hydraulic or other actuation circuitry, and other appropriate circuitry.

Controller 104 may also include stored and/or derived values 116 for use by module 108. For example, the stored and/or derived values 116 may include pump speed, pump life remaining, and one or more cavitation damage look-up tables or maps. Pump speed may be derived from a virtual pump speed sensor. For example, engine speed (e.g., crankshaft speed) may correspond to a speed of pump 20 and controller 104 may derive pump speed from engine speed signal 112. Pump speed may also be derived from other sources, such as other sensors (e.g., physical or virtual sensors) associated directly or indirectly with pump 20. Pump life remaining may include a stored value indicative of pump life remaining of pump 20 that may be decremented as engine system 10, and thus pump 20, operates. The value indicative of pump life remaining of pump 20 may be set for a particular amount of time (e.g., seconds, minutes, hours, etc.) of operation that is based on typical life of a pump. Pump life remaining may include an initial stored full pump life value when the pump is new (e.g., has not yet been operated). Accordingly, the pump life remaining value (e.g., the full pump life value) may be decremented by an amount of time pump 20 is on and operating during normal operation. Thus, the pump life remaining value may be updated as pump 20 is operated and the updated value may be stored by controller 104. In some instances, cavitation damage of pump 20 may reduce pump life, and thus pump life remaining may decrement at a faster rate than during normal operation.

Figure 3:
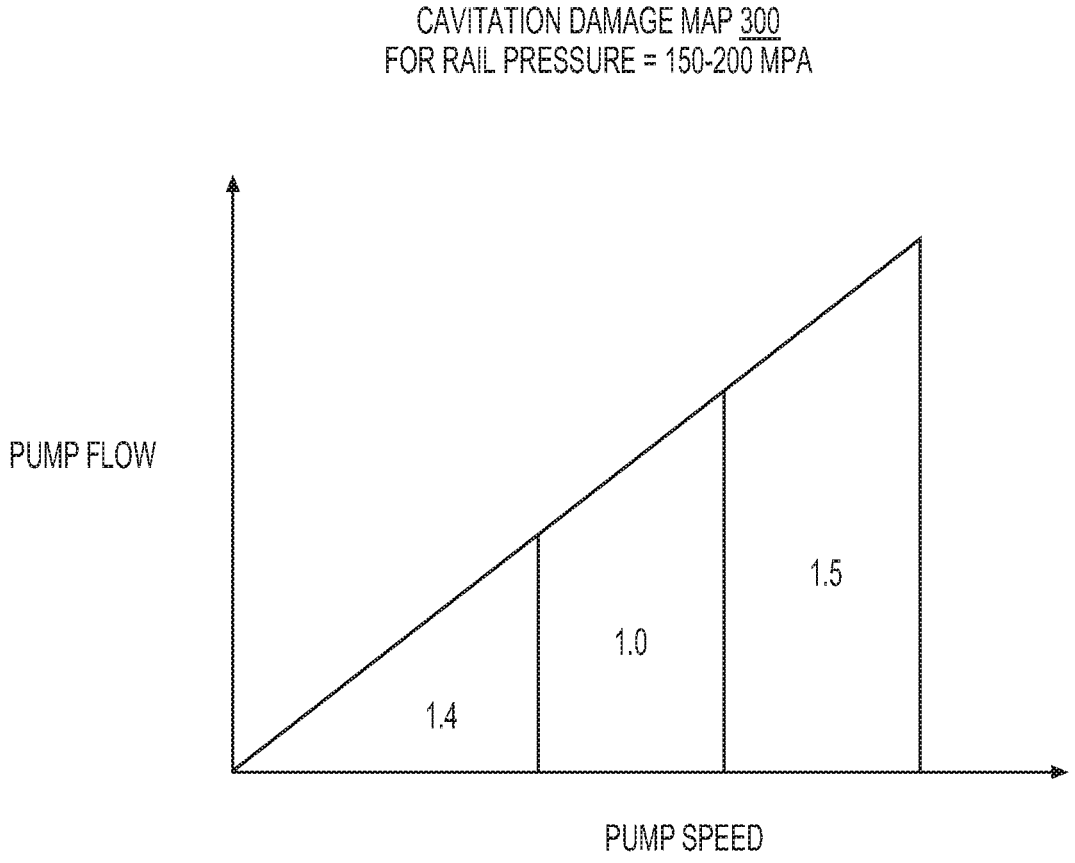
FIG. 3 is a chart illustrating an exemplary cavitation damage map according to one aspect of the present disclosure.

The cavitation damage look-up tables or maps provide values indicative of cavitation damage. An exemplary cavitation damage map 300 is depicted in FIG. 3. As shown in FIG. 3, a cavitation damage map 300 may plot pump speed versus pump flow for rail pressure in a certain pressure range (e.g., between 150-200 MPa). The cavitation damage map 300 may include three dimensional (3D) maps. For example, different rail pressure ranges may each include a different map 300 plotting pump speed versus pump flow. The information used to derive each cavitation damage map may be determined by empirical analysis. Such empirical data may be obtained by operating engine system 10 under predetermined conditions (e.g., under particular operating conditions) during, for example, bench testing. For each rail pressure range, the values indicative of cavitation damage may be correlated to the operating conditions (e.g., pump speed versus pump flow). For example, the cavitation damage map 300 may include different zones corresponding to different cavitation factors (e.g., 1.4, 1.0, and 1.5). Each zone may correspond to a rate of cavitation damage accumulation when the operating conditions (rail pressure pump speed, pump flow) are in a respective zone.

The cavitation factors may be dimensionless values that correspond to an amount that cavitation damage in the respective zone effects pump life remaining. For example, cavitation damage may not be present in pump 20 when the operating conditions are in zone 1.0, and thus pump life remaining may decrement by a cavitation factor of 1.0. When the operating conditions are in zones 1.4 or 1.5, cavitation damage may be present in pump 20, and pump life may be reduced. Thus, pump life remaining may decrement at a faster rate when the operating conditions are in zones 1.4 or zone 1.5 (e.g., by a factor of 1.4 or 1.5). It is understood that the cavitation maps may include any number of maps and may include any number of zones corresponding to any cavitation factor value.

Referring again to FIG. 2, the pump life remaining indicator signal output 106 may include control of aspects of engine system 10. For example, pump life remaining indicator signal output 106 may include controller 104 outputting a signal to display a value indicative of pump life remaining on output indicator 16 (e.g., on a display). Pump life remaining indicator signal may also include controller 104 outputting an alert, such as a light, an audible alert, an alert on a display, or the like when pump life remaining decreases below a threshold.

INDUSTRIAL APPLICABILITY

The disclosed aspects of the pump life prediction system 100 of the present disclosure may be used in any system having a pump 20 that may be subject to cavitation damage.

With reference to FIG. 1, during operation of engine system 10, plunger 28 may be controlled to move down to draw fuel from tank 18 into pump 20 through valve 30. Plunger 28 may then be controlled to move up to compress (e.g., pressurize) the fuel and push the pressurized fuel out of the pump 20. Outlet valve 32 may open when the fuel pressure is greater than rail pressure to provide the pressurized fuel to rail 22. The pressurized fuel may then be injected through injectors 26 into the cylinders of engine 14, and combustion of the fuel (and air) in the cylinders may cause rotation of the crankshaft to provide useful mechanical power. In some instances, cavitation damage may occur in pump 20. For example, under certain operating conditions, vapor pressure of the fuel may drop below a threshold and air bubbles may form in the fuel. When the fuel is then pressurized, the air bubbles may implode causing damage to components of pump 20. Cavitation damage may reduce the life of pump 20, and thus pump life remaining may decrement at faster rates than expected. Accordingly, pump 20 may fail sooner than expected with little or no warning.

Figure 4:
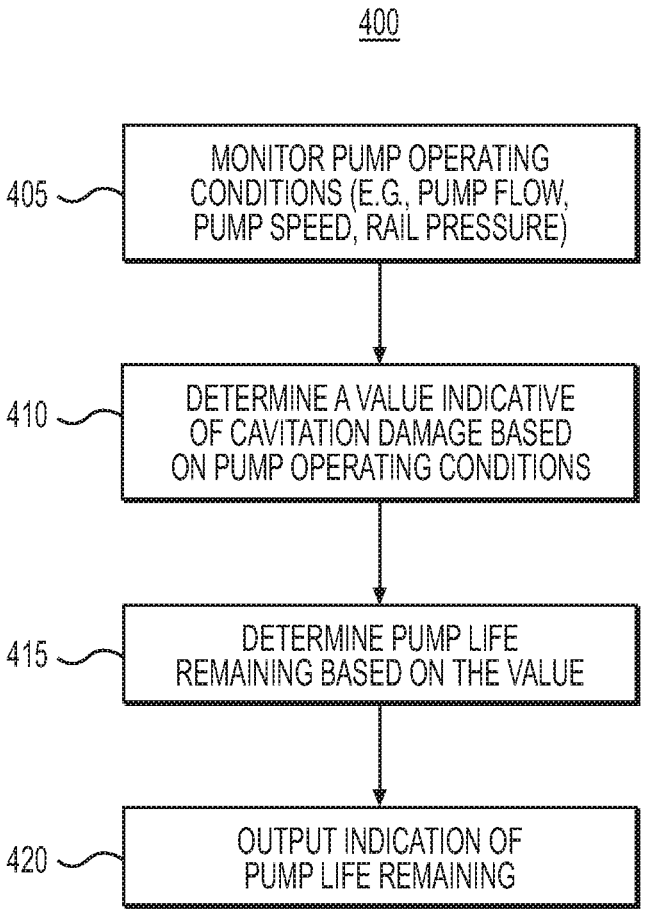
FIG. 4 provides a flowchart depicting an exemplary method for predicting pump life for the system of FIG. 1, according to one aspect of the present disclosure.

FIG. 4 illustrates a flowchart depicting an exemplary method 400 for predicting pump life of a high pressure pump 20. In step 405, module 108 may monitor the pump operating conditions. For example, controller 104 (via module 108) may monitor rail pressure signal 110, pump speed (e.g., derived from engine speed signal 112), and pump flow signal 114. In step 410, module 108 may determine a value indicative of cavitation damage based on the pump operating conditions. For example, the value may be a rate of cavitation damage accumulation in pump 20. In step 415, module 108 may determine pump life remaining based on the value indicative of cavitation damage. In step 420, module 108 may output an indication of the pump life remaining. For example, module 108 may display the pump life remaining on output indicator 16 (e.g., on a display). The display of the pump life remaining may include a countdown of pump life remaining in real-time and/or may include an adjusted full pump life (adjusted based on cavitation damage). In one embodiment, module 108 may display a notification via output indicator 16 (e.g., a light, an audible alert, an alert on a display, etc.) when the pump life remaining decreases below a predetermined threshold, as detailed below.

Figure 5:
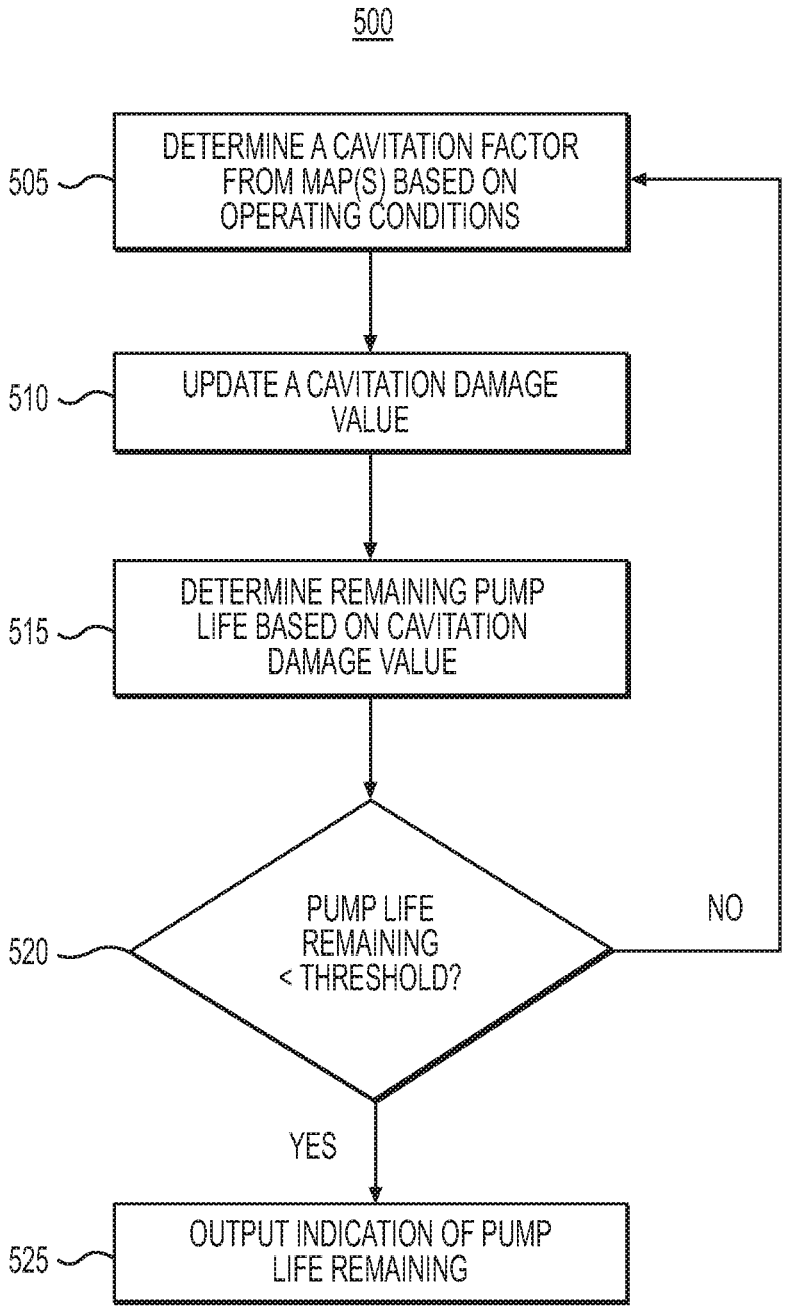
FIG. 5 provides a flowchart depicting a method including a detailed implementation of performing the method of FIG. 4.

FIG. 5 illustrates a flowchart depicting a method 500 for predicting pump life of a high pressure pump 20. It is noted that method 500 may include one example of implementing method 400 of FIG. 4. However, method 400 may be implemented in other ways. For example, module 108 may monitor pump operating conditions in step 405. To determine a value indicative of cavitation damage (step 410), in step 505, module 108 may determine a cavitation factor from the cavitation damage maps 300 (FIG. 3) based on the monitored operating conditions (e.g., pump flow, pump speed, and rail pressure). For example, module 108 may plot the operating conditions on the respective cavitation map for the monitored rail pressure. In an exemplary embodiment, if the operating conditions are in zone 1.4 (FIG. 3), module 108 may determine the cavitation factor is 1.4.

In step 510, module 108 may update a cavitation damage value. The cavitation damage value may be a stored time value factored by the cavitation factor. For example, module 108 may multiply the cavitation factor (e.g., 1.4) by a cycle time (e.g., the amount of time the pump life module runs through steps 505-510 of method 500). This value may be added to a stored previous cavitation damage value to update the cavitation damage value (step 510). In the exemplary embodiment, the cycle time may be one second and module 108 may update the cavitation damage value by adding 1.4 (e.g., determined by 1.4×1 second) to the stored cavitation damage value. Thus, the cavitation damage value may be an amount of time (e.g., cycle time) factored by an amount that cavitation effects pump life remaining. Module 108 may then store the new cavitation damage value.

To determine pump life remaining based on the value (step 415), in step 515, module 108 may determine pump life remaining based on the cavitation damage value. Pump life remaining is equal to the full pump life minus the cavitation damage value. Thus, pump life remaining may be an amount of time of life remaining for pump 20. Module 108 may cycle method 500 at regular intervals (e.g., 1 second intervals) such that module 108 may determine a duration the pump operating conditions are in each zone of the cavitation damage maps. Thus, pump life remaining may be determined based on the duration the pump operating conditions are in each zone.

To output the indication of pump life remaining (step 420), module 108 may then compare the pump life remaining to a threshold. For example, in step 520, module 108 may determine if pump life remaining is less than a threshold. The threshold may be a predetermined value (e.g., 10% of full pump life remaining) stored by controller 104. If pump life remaining is greater than the threshold (step 520: NO), module 108 may cycle to step 505. If pump life remaining is less than or equal to the threshold (step 520: YES), module 108 may output an indication of pump life remaining (step 525). For example, module 108 may output a signal to output indicator 16 to turn on a light, to output an audible alert on a speaker, or to output an alert on a display indicating a need to replace or repair pump 20.

Pump life prediction system 100 may enable prediction of pump life remaining for pump 20. For example, pump life prediction system 100 may detect reduced pump life due to cavitation damage in pump 20. Accordingly, pump life prediction system 100 may more accurately indicate pump life remaining and proactively alert a user (e.g., operator, technician, etc.) so that the user may repair and/or replace pump 20 prior to failure of pump 20.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A method for predicting pump life of a pump, comprising:

monitoring pump operating conditions;

determining a value indicative of cavitation damage based on the pump operating conditions, wherein the value is a rate of cavitation damage accumulation;

determining a pump life remaining based on the value; and outputting an indication of the pump life remaining.

2. The method of claim 1, wherein the pump operating conditions include at least one of pump flow or pump speed.

3. The method of claim 1, wherein the value is determined based on one or more maps representative of empirical data of cavitation damage of the pump with respect to the pump operating conditions.

4. The method of claim 3, wherein the one or more maps include different zones corresponding to different values indicative of cavitation damage.

5. The method of claim 4, further including determining a duration the pump operating conditions are in each zone.

6. The method of claim 5, wherein the pump life remaining is determined based on the duration the pump operating conditions are in each zone.

7. The method of claim 1, wherein the indication of pump life remaining includes displaying at least one of: the pump life remaining or a notification when the pump life remaining decreases below a predetermined threshold.

8. The method of claim 1, wherein the pump is a fuel pump for an engine system, and further including pumping fuel from the fuel pump to a common rail.

9. A method for predicting pump life of a fuel pump for an engine system having a common fuel rail, comprising:

monitoring pump flow of the fuel pump, pump speed of the fuel pump, and rail pressure of the common fuel rail, the common fuel rail being fluidly connected to the fuel pump;

determining a value indicative of cavitation damage based on the pump flow, the pump speed, and the rail pressure;

determining a pump life remaining based on the value; and outputting an indication of the pump life remaining.

10. The method of claim 9, wherein the indication of pump life remaining includes displaying at least one of: the pump life remaining or a notification when the pump life remaining decreases below a predetermined threshold.

11. The method of claim 9, wherein the value is determined based on one or more maps representative of empirical data of cavitation damage of the pump with respect to the pump flow, the pump speed, and the rail pressure.

12. The method of claim 11, wherein the one or more maps include different zones corresponding to different values indicative of cavitation damage.

13. The method of claim 12, further including determining a duration the pump operating conditions are in each zone.

14. The method of claim 13, wherein the pump life remaining is determined based on the duration the pump operating conditions are in each zone.

15. A pump life prediction system, comprising:

a pump;

a common rail, the common rail being fluidly connected to the pump;

one or more sensors for measuring pump operating conditions;

a rail sensor for measuring rail pressure of the common rail; and a controller configured to:

monitor the pump operating conditions;

determine pump flow of the fuel pump and pump speed of the fuel pump based upon the pump operating conditions;

determine a rail pressure of the common rail;

determine a value indicative of cavitation damage based on the pump flow, the pump speed, and the rail pressure;

determine a pump life remaining based on the value; and output an indication of the pump life remaining.

16. The system of claim 15, wherein the pump operating conditions include at least one of pump flow or pump speed.

17. The system of claim 16, wherein the value is determined based on a map representative of empirical data of cavitation damage of the pump with respect to the pump operating conditions.

18. The system of claim 17, wherein the map includes different zones corresponding to different values indicative of cavitation damage.

19. The system of claim 18, wherein the controller is further configured to:

determine a duration the pump operating conditions are in each zone.

20. The system of claim 19, wherein the pump life remaining is determined based on the duration the pump operating conditions are in each zone.

* * * * *